United States Patent [19]

Inger et al.

[11] 4,453,377

[45] Jun. 12, 1984

[54] TWO-FOR-ONE TWISTING SPINDLE

[75] Inventors: Siegfried Inger; Heinz Fink, both of Krefeld, Fed. Rep. of Germany

[73] Assignee: Palitex Project-Company GmbH, Krefeld, Fed. Rep. of Germany

[21] Appl. No.: 376,762

[22] Filed: May 10, 1982

[30] Foreign Application Priority Data

May 13, 1981 [DE] Fed. Rep. of Germany ..... 3118873

[51] Int. Cl.[3] ..... D01H 15/00; D01H 7/86; D01H 13/16

[52] U.S. Cl. ..... 57/279; 57/58.86; 57/86; 57/87

[58] Field of Search ..... 57/58.49, 58.7, 58.83, 57/58.86, 279, 280, 86, 87

[56] References Cited

U.S. PATENT DOCUMENTS 4,199,929 4/1980 Vessalla ..... 57/58.7 X
4,281,508 8/1981 Frentzel-Beyme ..... 57/58.86 X
4,287,712 9/1981 Franzen ..... 57/58.86 X
4,302,930 12/1981 Franzen ..... 57/279
4,354,343 10/1982 D'Agnolo et al. ..... 57/279

*Primary Examiner*—John Petrakes

[57] ABSTRACT

A two-for-one twisting spindle has a compressed-air-actuating device which is disposed in the region of the hollow axle (21) of the spindle (1) above the spindle rotor, and which influences the run of the yarn and to which a compressed-air passage (29), extending through a stationary part (7) of the spindle, leads, in order to prevent the yarn from being drawn through the hollow axle of the spindle in the event of breakage of the yarn. The compressed-air-actuated device is a compressed-air-cylinder (27) whose axis intersects the hollow axle of the spindle at right angles thereto and whose outer wall has two openings (25) which are located diametrically opposite one another and which are in alignment with the hollow axle of the spindle, and a piston (26) which is displaceable within the compressed-air cylinder and whose rear end is subjectable to compressed air for the purpose of clamping (FIG. 1), or cutting (FIG. 5) through the yarn.

14 Claims, 8 Drawing Figures

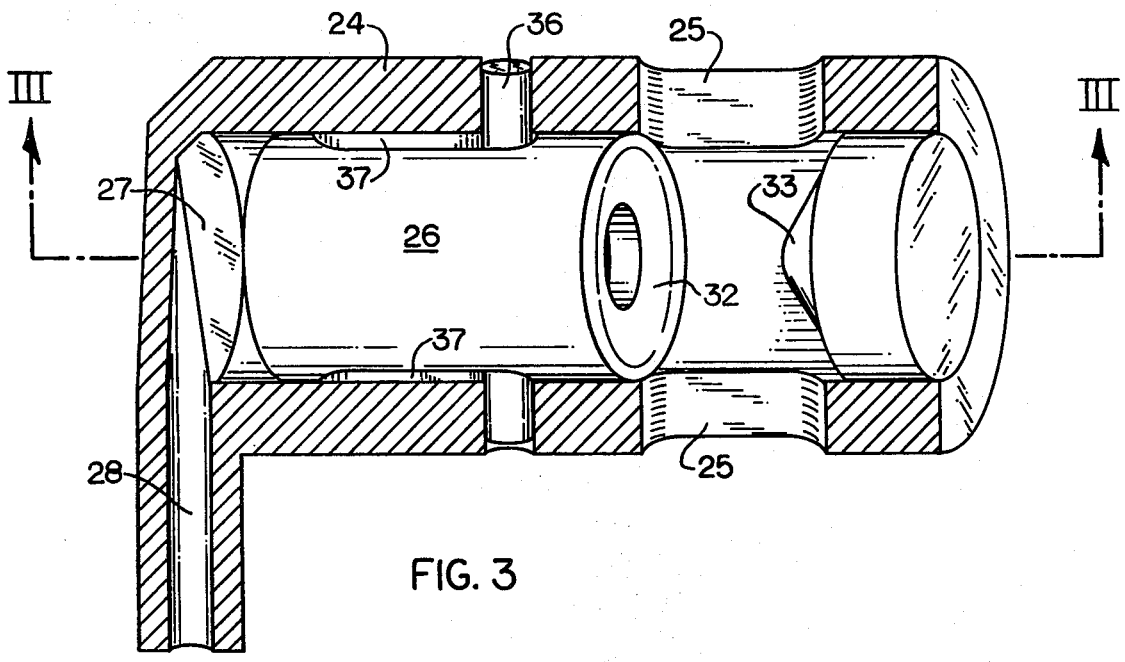
FIG. 3
FIG. 4
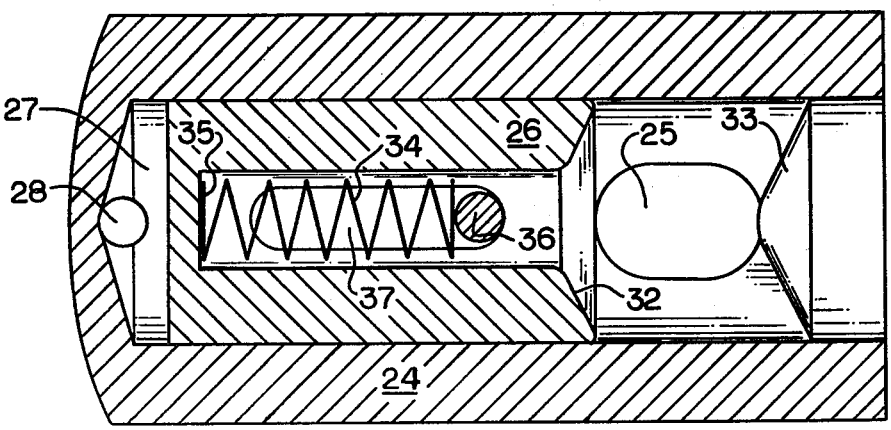

TWO-FOR-ONE TWISTING SPINDLE

BACKGROUND AND OBJECTIVES OF THE INVENTION

The invention relates to a two-for-one twisting spindle.

The two-for-one twisting spindle described in British Patent Specification No. 1497756 has a compressed-air-actuated threading device by means of which the yarn is drawn in to the hollow axle of the spindle by injector action and is coveyed through a yarn guide passage of a yarn reserve disc by the jet of compressed air. In this compressed-air-actuated threading device, an injector nozzle is disposed directly above the spindle rotor and is directed towards the yarn reserve disc, and a passage forming part of a basket or protection pot leads from the outer periphery thereof to the injector nozzle, a source of compressed air being connectible to the external mouth of the passage by way of a connection piece.

In another two-for-one twisting spindle of this kind described in, for example, German Patent Specification No. 27 33 318, the compressed air passage extends substantially parallel and adjacent to the yarn entry tube.

It is common knowledge that two-for-one twisting spindles tend to draw in yarns after breakage of the yarn. The undesireable effect on a two-for-one twisting spindle is caused by physical factors, particularly by the ventilating action of the spindle rotor and the centrifugal forces which act in the spindle rotor upon the portion of the yarn remaining therein. After the yarn, which has been drawn in in this manner, emerges from the spindle rotor, the yarn either forms a lap on the neck of the wharve or on the rotor, or the yarn is broken on parts of the machine. This results in increased expenditure on maintenance, and, in extreme cases, can lead to interference with the yarn on adjacent spindles and to an increased consumption of power by the spindle.

In order to avoid this phenomenon, a mechanical yarn-catching or yarn-stopping device is chiefly used in two-for-one twisting spindles but, however, leads to additional operating costs and involves a certain amount of operational unreliability. As described in British Patent Specification No. 1047645, a thread-catching or thread-stopping devce is normally pivotably disposed away from the region of the spindle. It usually has a yarn sensor which rests on the yarn. In the event of breakage of the yarn, the thread-catching or thread-stopping device pivots towards the yarn running from the feed bobbin. Either the device, by means of a special catching head, prevents further yarn from being pulled off the bobbin and fed into the spindle, or, for example, the flying yarn is arrested by the stopping device.

An operationally reliable spindle-braking unit which is deescribed in, for example, British Pat. No. 1339211, and which is also controlled by a yarn-sensing device, can be mentioned as a further device for preventing the drawing-in of a yarn after yarn breakage. In the event of yarn breakage, this yarn-sensing device transmits a control pulse to a mechanical or pneumatic device which either disengages the spindle from the drive belt or the drive belt from the spindle by pivoting or displacement. A spindle-braking device of this kind also involves increased structural and operating costs.

An object of the invention is to provide a two-for-one twisting spindle such that the drawing-in of a yarn after breakage is prevented by simple and reliable means, and the yarn is, as far as possible, still held within the spindle.

The present invention comprises a two-for-one twisting spindle in which a compressed-air-actuated device which is adapted to affect or influence the running through of the yarn is disposed in the region of the hollow axle of the spindle (particularly above the spindle rotor), and has an element which is movable substantially at right angles to the path of the yarn and to which a compressed-air passage, extending through a stationary part of the spindle, leads.

In one embodiment, the compressed-air-actuated device includes a piston or lining, which is movable substantially at right angles to the path of the yarn.

In one preferred embodiment of the invention, the compressed-air-actuated device has a compressed-air cylinder whose axis intersects the hollow axle of the spindle at a right angle thereto and whose outer wall has two openings which are located diametrically opposite on another and which are in alignment with the hollow axle of the spindle, the compressed-air cylinder also having a piston which is displaceable within the compressed-air cylinder and whose rear can be subjected to compressed air. When, in an arrangement of this kind, the piston is subjected to compressed air fed through stationary parts of the spindle as a result of a control pulse originating from a yarn sensor after breakage of the yarn, the piston is advanced within the compressed-air cylinder from a rest position into an operating position and it moves at least temporarily into the region of the openings in the outer wall of the compressed-air cylinder which are in alignment with the hollow axle of the spindle, thus interrupting further feeding of the yarn.

Either the yarn can be retained between the piston and a counter-clamping surface by clamping action, or the piston can be provided with a cutting edge for cutting through the yarn.

A compressed-air-actuated thread cutter has already been described in a general form in German Utility Model (Gebrauchsmuster) No. 80 27 354, although this publication does not contain any reference as to how a thread cutter of this kind can be used efficiently in conjunction with a two-for-one twisting spindle.

When the yarn is clamped, the piston can remain in its advanced position until, for example, the commencement of the maintenance work for repairing the yarn breakage.

When the piston, which is adjusted transversely of the hollow axle of the spindle, cuts through the thread in a manner similar to the punch principle, the yarn is held by the yarn brake towards the feed bobbin, while the yarn released towards the take-up bobbin is drawn out of the rotor through the hollow axle under the action of centrifugal force. The spindle itself does not need to be decelerated in order to render the "yarn-clamping device" or "yarn cutter" effective.

The two-for-one twisting spindle in accordance with the invention may be constructed so that it is reliable and simple in operation, no additional space being required owing to the fact that the yarn clamping device or yarn cutter are integrated within the spindle, so that the partitioning of the machine, i.e. the protection of the twisting spindles from one another in the case of the multi-spindle machine, is not affected. The elements required for equipping or converting for a two-for-one twisting spindle are of simple construction and are simple to install. Moreover, the operation of a spindle of this kind is simplified, since an operator no longe has to pay attention to additional elements, such as a yarn braking device which is othewise customary, and which also necessitate a further working operation.

BRIEF DESCRIPTION OF DRAWINGS OF THE INVENTION

The invention will be further described by way of example, with reference to the accompanying drawings, in which:

FIG. 3 is a fragmentary section, drawn partially in perspective, through the actual yarn clamping device, drawn to an even larger scale;

FIG. 4 is a horizontal section taken on the line III—III of FIG. 3;

DETAILED DESCRIPTION OF PREFERRED EMBODIMENTS OF THE INVENTION

Figure 1:
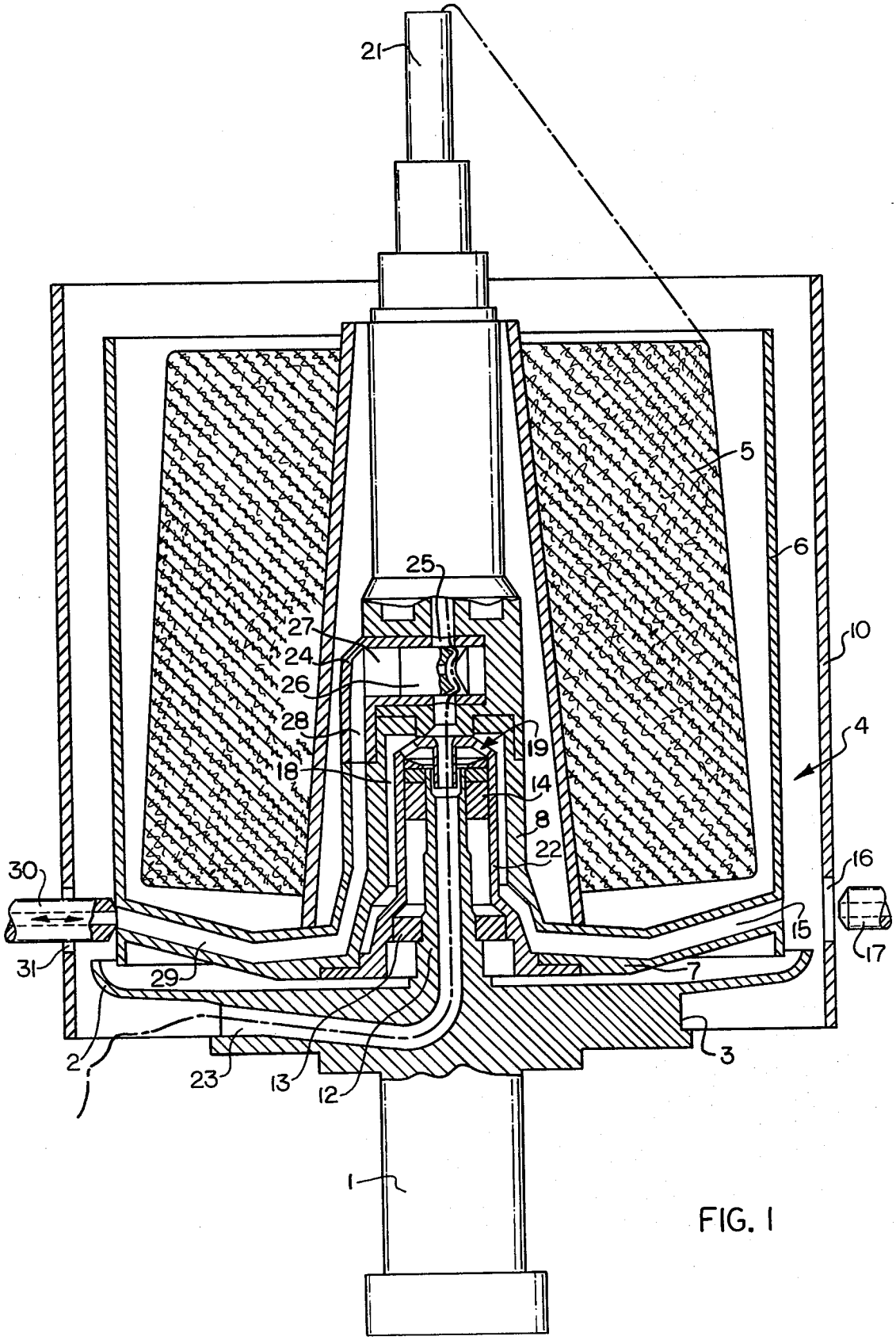
FIG. 1 is a fragmentary axial section through a two-for-one twisting spindle in accordance with the invention, having a yarn clamping device integrated within the spindle.
Figure 5:
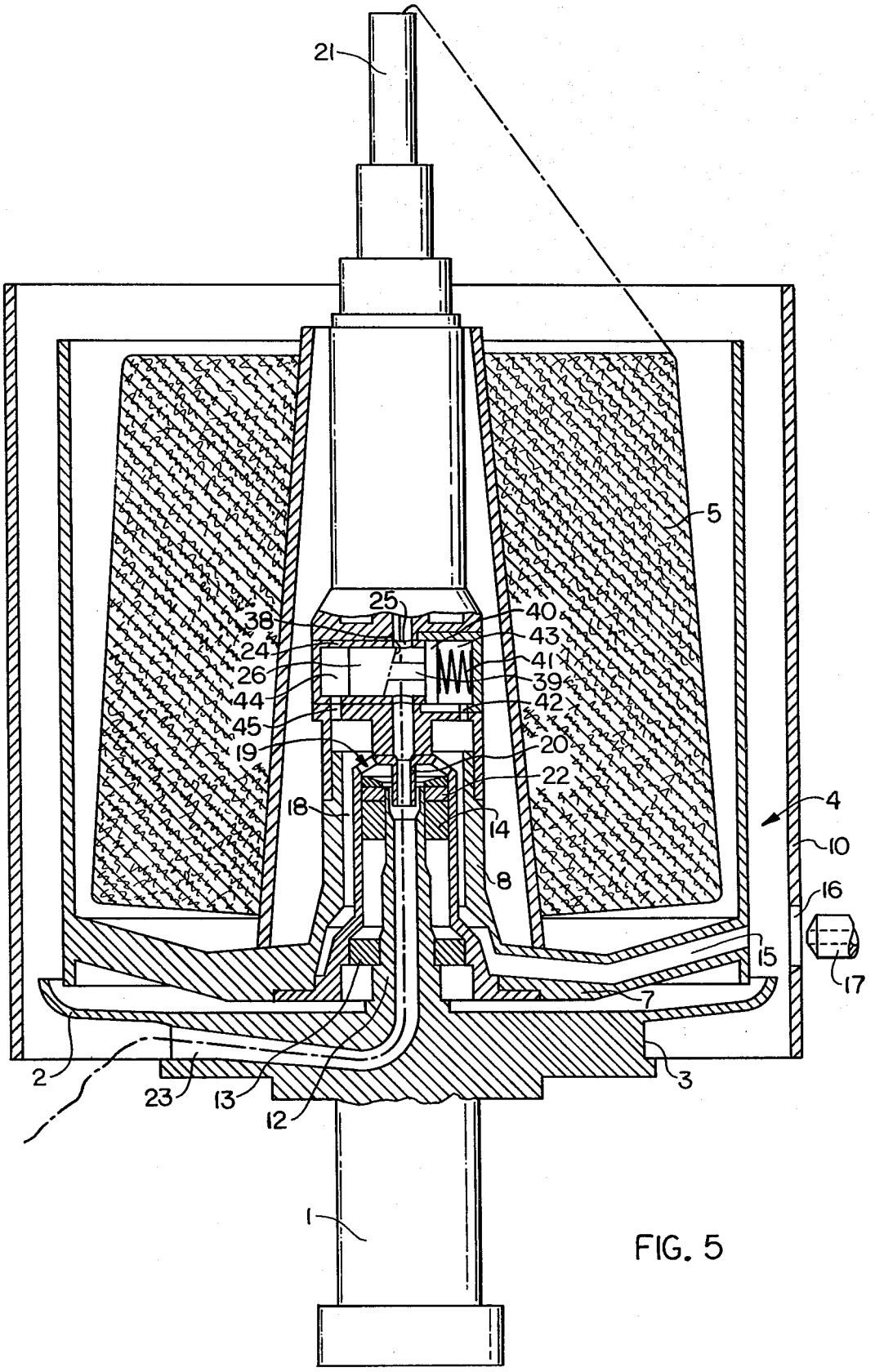
FIG. 5 is a fragmentary axial section through a modified embodiment of a two-for-one twisting spindle, with an associated yarn cutter.
Figure 6:
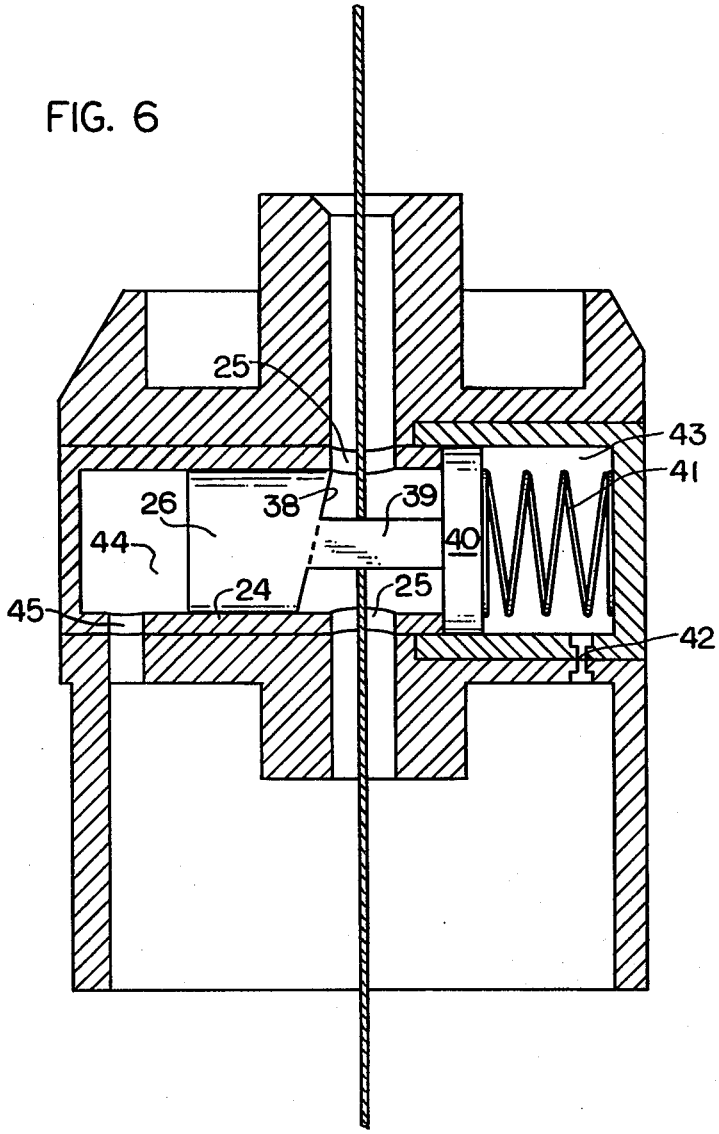
FIG. 6 is a sectional view, drawn to a larger scale, of the actual yarn cutter, with associated parts of the spindle.
Figure 7:
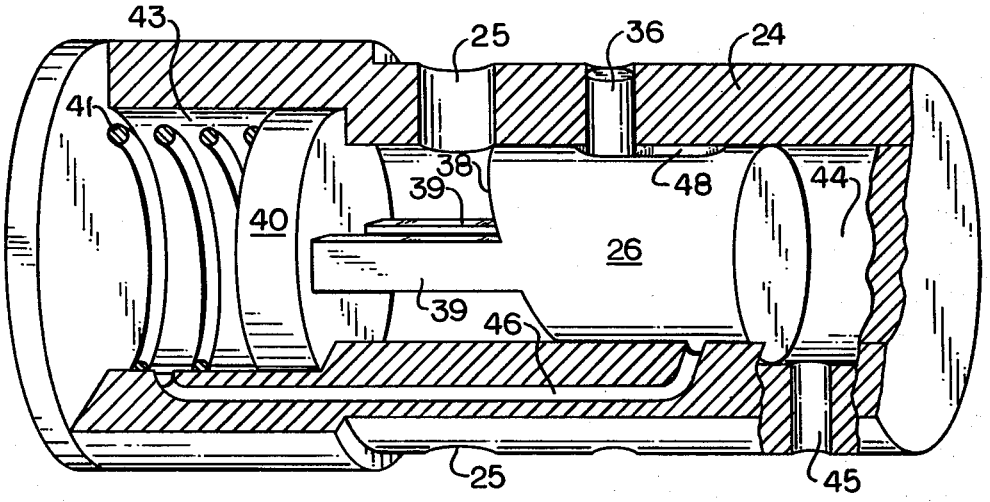
FIG. 7 is a fragmentary section, drawn partially in perspective, through the yarn cutter of FIGS. 5 and 6.
Figure 8:
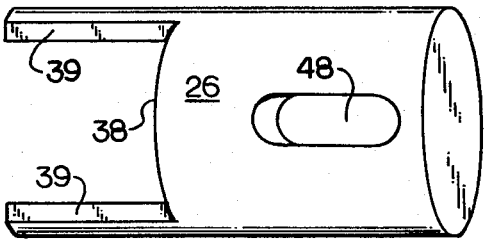
FIG. 8 is a perspective illustration of a part of the yarn cutter illustrated in FIG. 7.

The two-for-one twisting spindles illustrated in FIGS. 1 and 5 each comprise, in a conventional manner, a wharve 1, a turntable 2 having a yarn reserve disc 3, and a protection pot or basket 4 which contains a creel bobbin or feed bobbin 5. The basket 4 comprises a wall 6, a base 7 and a hollow hub 8. The basket 4 is equipped with magnets (not illustrated) which, in order to hold the protection pot 4 from rotating, cooperates with magnets (also not illustrated) fixedly disposed outside a fixed ballooning limiter 10, as described in British Patent No. 1497756. The protection pot 4 is mounted on the spindle rotor 12 by way of interposed bearings 13, 14.

In conformity with the two-for-one twisting spindle which is described in British Patent Specification No. 1497756, and which is provided with a compressed-air-actuated threading device, the base 7 of the protection pot contains a radially extending portion 15 of a compressed-air passage. An opening 16 in the ballooning limiter 10 is located in registry with the external mouth or orifice of this portion 15 of the passage. A connection piece 17, connected to a source of compressed air (not illustrated), can be inserted through the opening 16 in order to admit compressed air into the portion 15 of the passage.

An annular portion 18 of the compressed-air passage is contiguous to the inner end of the radially-extending portion 15 of the passage and extends through the hollow hub 8 of the protection pot and leads to an injector nozzle 19 which is disposed directly above the spindle rotor 12 and directed towards the yarn reserve disc 3. The injector nozzle 19 comprises a tubular member 22 which is inserted centrally into the hollow hub 8 of the protection pot, one end of which tubular member is connected to the portion 18 of the compressed-air passage and its other end extends into the spindle rotor 12. A tube 20 extends into the tubular member 22 from above so as to leave a gap therebetween, and forms the lower extensin of the yarn feed tube 21 or of the fixed part of the hollow axle of the spindle.

If a yarn is to be threaded through the hollow axle of the spindfle, the connection piece 17 is inserted through the opening 16 and connected to the portion 15 of the compressed-air passage, so that, after a valve (not illustrated) has been actuated, compressed air can flow to the injector nozzle 19 through the compressed-air passage 15,18. A yarn held on, for example, the top end of the yarn feed tube 21, is drawn in by the suction produced by the injector nozzle 19, and after passing through the injector, is conveyed through the hollow axle of the spindle and through the yarn exit passage 23 by the jet of compressed air. The jet of compressed air subsequently conveys the yarn further upwardly through the gap between the ballooning limiter 10 and the wall 6 of the protection pot.

The connection piece 17 is withdrawn up completion of this threading operation, so that the gap between the ballooning limiter 10 and the wall 6 of the protection pot is again free.

Figure 2:
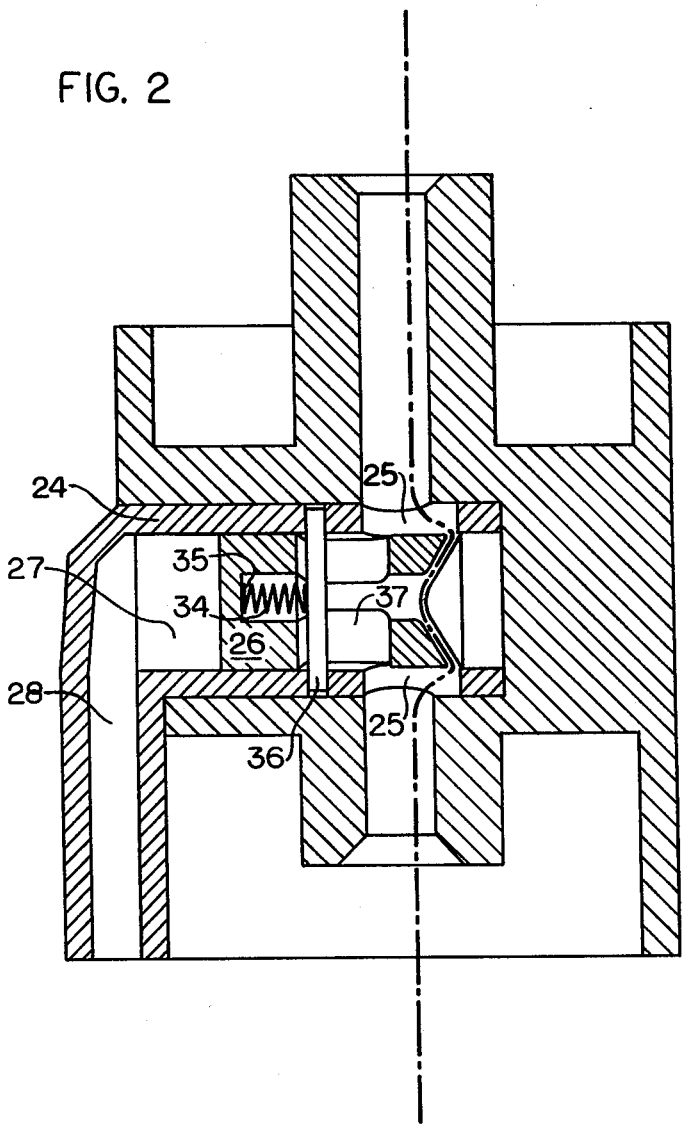
FIG. 2 is an axial section, drawn to a larger scale, through the actual yarn clamping device, with associated parts of the spindle.

In according with the embodiment of the invention, illustrated in FIG. 1, the two-for-one twisting spindle is equipped with a compressed-air-actuated device for clamping a yarn within the spindle. The compressed-air-actuated device comprises a compressed-air cylinder 24 whose axis intersects the hollow axle of the spindle at right angles thereto and whose outer wall incorporates two openings 25 which are located diametrically opposite one another and which are in alignment with the hollow axle of the spindle (see particularly FIGS. 2 and 4). A piston 26 is mounted within the compressed-air cylinder 24 and its rear end defines a working chamber 27 into which a vertical passage portion 28, guided along the hollow hub 8 of the protection pot, opens and, together with a horizontal passage portion 29, guided through the base 7 of the protection pot, forms a compressed-air passage to the outer orifice of which can be applied a nozzle 30 which is connectible to a source of compressed air and which can be pushed through an opening 31 in the ballooning limiter 6.

The front end of the piston 26 is in the form of a clamping surface 32 opposite to which is located a fixed counter-clamping surface 23 disposed within the compressed-air cylinder 24 and away from the path of the yarn formed by the openings 25. The piston 26 is a hollow piston accommodating a compression spring 34 which serves as a return element for the piston, one end of which compression spring rests against an abutment which is disposed in the region of the rear of the piston and which is in the form of a piston head 35, and the other end of whichcompression spring rests against a fixed abutment extending into the piston through the wall thereof. The fixed abutment comprises a pin 36 which is secured in the outer wall of the compressed-air cylinder 24 and which is guided through mutually opposite located axial slots 37 in the wall of the piston. The pin 36 thus also determines the retracted end positin of the piston.

When the drawing of the yarn through the hollow axle of the spindle is to be prevented or terminated in the event of breakage of the yarn, the nozzle 30, controlled by a conventional yarn funnel or yarn sensor, is applied to the outer orifice of the compressed-air passage 29,28, so that, when compressed air is fed through this nozzle and thus to the compressed air passage, the piston 26 is displaced forwardly or towards the counter-clamping surface 33. The yarn passing through the hollow axle of the spindle, and thus also along the yarn path defined by the openings 25, is thereby clamped between the clamping surface 32 and the counter-clamping surface 33, so that further drawing-through of the thread is prevented.

The supply of compressed air to the compressed-air cylinder is terminated in order to put the spindle into operation again,so that the compression spring 34 returns the piston 26 to its starting position which is illustrated particularly in FIGS. 3 and 4.

In the embodiment of the invention illustrated in FIGS. 5 to 8, the piston 26 is also in the form of a cutting piston, that is to say, it is provided with a cutting edge 38 in the region of its front end. In this embodiment of the invention, a disc 40 having a larger diameter than that of the piston 26 is secured to the front surface of the piston 26 by means of spacer fingers 39 which are provided laterally of the yarn path formed by the openings 25. In this manner, the piston 26 and the disc 40 together form a so-called double-acting stepped piston, a return spring 41 acting upon the front side of the disc 40.

In the arrangement of FIG. 5, compressed air is fed to the compressed-air cylinder 24 through the compressed-air passage 15, 18 which is also associated with the compressed-air-actuated threading device and to which compressed air can be admitted by way of the connection piece 17. The working chamber 43 defined by the disc 40 is connected by way of a throttle 42 to the same compressed-air passage 15,18 to which the working chamber 44 defined by the piston 26 is connected. When a yarn breakage occurs, compressed air is admitted to the connection piece 17 by means of a yarn sensor and a control valve, and the connection piece 17 is moved into abutment against the external orifice of the passage portion 15. With the spindle running, compressed air is thereby fed to the threading injector on the one hand while, on the other hand, compressed air is delivered to the working chamber 44 through a connection line 45, whereby the piston 26 is extended and a yarn running through the hollow axle of the spindle and thus through the openings 25 is severed.

At the same time as compressed air is being fed into the working chamber 44, compressed air is also being fed into the working chamber 43 by way of the throttle 42 and acts upon the disc 40. As soon as the pressures in the two working chambers 43 and 44 have been equalized in dependence upon the size of the throttle 42, the stepped piston formed by the piston 26 and the disc 40 is returned to its starting position with the assistance of the return spring 41, so that the path of the yarn through the hollow axle of the spindle, and thus the openings 25, become free again.

In order to accelerate the return movement of the stepped piston, the two working chambers 43 and 45 are interconnected by a secondary line 46 (FIG. 7) whose mouth, opening into the working chamber 44 defined by the piston 26, is closed by the piston 26 when the latter is in its normal or rest state. As soon as the secondary line 46 is connected to the working chamber 44 during the advance of the piston 26, compressed air also flows through the secondary line 46 into the working chamber 43, whereby the return movement of the stepped piston, formed by the piston 26 and the disc 40, is assisted or accelerated into its starting position illustated in, for example, FIG. 7.

A stop-and-guide pin 36 is inserted into the outer wall of the compressed air cylinder 24 and extends into an axial groove 48 which is incorporated in the piston 25 and which determines the advanced and retracted end positions of the piston.

We claim:

1. A two-for-one twisting spindle having a stationary portion, a spindle rotor and a hollow axle above said rotor, in combination with a compressed-air-actuated means adapted to influence the running through of a yarn disposed in said hollow axle of said spindle above said spindle rotor, a compressed air passage communicating with said compressed-air-actuated means and said hollow axle, and means movable substantially at right angles to the path of the yarn in said compressed air passage, said compressed air passage extending through a stationary portion of said spindle, said compressed-air-actuated means having a compressed-air cylinder whose axis intersects said hollow axle of said spindle at right angles thereto, said cylinder having an outer wall having two openings located diametrically opposite one another and in alignment with said hollow axle of said spindle, and the said means of said compressed-air-actuated means comprising a piston displaceable within said compressed-air cylinder and responsive in displacement in said cylinder to compressed air.

2. A two-for-one twisting spindle as claimed in claim 1, said compressed-air-actuated means clampingly retains said yarn by said piston, said piston having a yarn clamping surface opposite said yarn clamping surface within said compressed-air cylinder and out of the yarn path of travel formed by said openings.

3. A two-for-one twisting spindle as claimed in claim 1, compressed-air-actuated means having a cutting edge on said piston which is guided within said compressed-air cylinder.

4. A two-for-one twisting spindle as claimed in claim 3, said piston is secured against rotation, at least one spacer finger having a front end guided laterally past said openings and being secured to the front of said piston, and resilient means cooperatively engaged with said spacer finger remote from the piston to displace said piston.

5. A two-for-one twisting spindle as claimed in claim 4, and a disc having a front face, said resilient means acting on said disc front face, said disc being secured to said spacer finger front end.

6. A two-for-one twisting spindle as claimed in claim 5 in which said piston and said disc form a double-acting stepped piston, the diameter of said disc being larger than the diameter of said piston, and a first working chamber being defined by said disc, a second working chamber defined by said piston, and a throttle connected to said chambers and to said same compressed-air passage.

7. A two-for-one twisting spindle as claimed in claim 6, in which said two working chambers are interconnected by a secondary line having a mouth opening into said second working chamber defined by said piston is closed by said piston when said piston is in its normal or resting state.

8. A two-for-one twisting spindle as claimed in claim 7, said piston having an axial groove, a stop and guide pin inserted into the wall of said compressed-air cylinder extends into said axial groove in said piston and which determines the advanced and retracted end positions of said piston.

9. A two-for-one twisting spindle as claimed in claim 1, said piston having an associated return spring having terminal ends which is effective in the opposite direction to the direction in which said piston is advanced when said piston is subjected to compressed air.

10. A two-for-one twisting spindle as claimed in claim 9, in which said piston is a hollow piston in which said return spring, in the form of a compression spring, is accommodated, one end of said spring rests against said piston opposite from said cutting edge, said cylinder having a stationary abutment extending into said piston, the outer end of said spring rests against said stationary abutment.

11. A two-for-one twisting spindle as claimed in claim 10, said stationary abutment having a pin, said compressed air cylinder having an outer wall, said pin being secured to said outer wall, said cylinder having axial slots located opposite to one another in the wall of said piston for guiding said pin.

12. A two-for-one twisting spindle comprising; a spindle rotor, a stationary portion and a hollow spindle axle, compressed-air-actuated threading means in juxtaposition with said hollow spindle axle above said spindle rotor operative in an injector-like manner, a first compressed air passage extending through said staionary portion of said spindle, a threading means including a compressed air cylinder having an axis intersecting with said hollow spindle axle at right angles thereto, said compressed air cylinder having two openings diametrically opposte each other and in alignment with said hollow spindle axle, a piston displaceable in said compressed air cylinder for clamping or cutting a yarn passing through said hollow spindle axle, and a second compressed air passage leading through said stationary portion of said spindle communicating with said first compressed air passage.

13. A two-for-one twisting spindle comprising; a spindle rotor, a stationary portion and a hollow spindle axle, a compressed-air-actuated yearn threading means disposed in said hollow spindle axle above said spindle rotor and acts in an injector-like manner, a compressed air cylinder in juxtaposition to said hollow spindle axle, a compressed air passage extending through said stationary portion of said spindle to said compressed air cylinder, said compressed air cylinder intersecting said hollow spindle axle at right angles above said threading means, said cylinder having two openings located diametrically opposite each other and in alignment with the hollow spindle axle, a double-acting stepped piston in said compressed air cylinder displaceable and displaceable therein for cutting a yarn passing through said hollow spindle axle, said stepped piston having a part in alignment with said hollow spindle axle when said stepped piston is in its normal position, a first working chamber defined by a smaller diameter on said stepped piston which chamber is connected directly to said compressed air passage, and second working chamber defined by a larger diameter on said stepped piston which secondchamber is connected to said compressed air passage, and a throttle connected said second chamber to said compressed air passage.

14. A two-for-one twisting spindle as claimed in claim 13, and a secondary line having a mouth opening into said first working chamber, said first and second working chambers being interconnected by said secondary line whereby said first working chamber is closed when said stepped piston is in its normal state.

* * * * *